United States Patent [19]

Arendsen et al.

[11] 4,014,658

[45] Mar. 29, 1977

[54] SOLVENT VAPOR VENTING DUST COVER UNIT FOR FRACTION COLLECTOR TURNTABLE

[75] Inventors: David Lloyd Arendsen, Libertyville; Carl William Nordeen, McHenry, both of Ill.

[73] Assignee: Abbott Laboratories, North Chicago, Ill.

[22] Filed: Apr. 28, 1975

[21] Appl. No.: 572,696

[52] U.S. Cl. ..... 23/292; 23/259; 98/115 LH; 141/93

[51] Int. Cl.[2] ..... B01L 1/00

[58] Field of Search ..... 23/292, 253 R, 272 SC; 141/93, 97, 51; 98/115 LH, 115 R; 73/421 R; 55/467

[56] References Cited

UNITED STATES PATENTS

| | | | |
|---|---|---|---|
| 234,879 | 11/1880 | Macurdy | 98/115 R |
| 2,604,248 | 7/1952 | Gorham | 141/130 |
| 2,604,249 | 7/1952 | Gorham | 141/130 |
| 2,654,522 | 10/1953 | Gorham | 141/130 X |
| 3,713,785 | 1/1973 | Moran | 23/292 |
| 3,760,446 | 9/1973 | Payton | 98/36 X |
| 3,880,061 | 4/1975 | Hensiek et al. | 98/36 X |

OTHER PUBLICATIONS

Aloe "Laboratory Apparatus–Equipment–Reagents" Catalog No. 103; Aloe Scientific; St. Louis, Mo.; 1952 p. 557.

Sargent–Welch Scientific Co.; "Scientific Laboratory Instruments–Apparatus"; 1971; p. 992.

*Primary Examiner*—Joseph Scovronek
*Assistant Examiner*—Arnold Turk
*Attorney, Agent, or Firm*—Gildo E. Fato; Robert L. Niblack

[57] ABSTRACT

A solvent vapor venting dust cover unit which automatically vents all volatile solvent vapors arising during the fraction collection procedure.

3 Claims, 5 Drawing Figures

SOLVENT VAPOR VENTING DUST COVER UNIT FOR FRACTION COLLECTOR TURNTABLE

BACKGROUND OF THE INVENTION

This invention relates to solvent vapor venting dust covers snd more particularly to a solvent vapor venting dust cover unit for a fraction collector turntable.

In the past, any work with solvents having toxic vapors had to be done in the hood. This work was long and tedious, and was always subject to space limitations. Further, due to these space limitations, oftentimes it was quite difficult to reach and handle the fractions being collected.

Recently the U.S. Government has passed the Occupational Safety and Health Act (OSHA). To fully comply with this act in laboratory situations is expensive. In such situations, restrictions are imposed on both employer and employee as to solvent vapor control. A typical restriction imposed is the requirement for the proper venting of solvent vapors in the hood.

Accordingly, an object of this invention is to provide a new and improved device which complies fully with the Occupational Safety and Health Act.

A further object is to provide a device which is kept outside the hood and yet does not subject the operator to any resulting toxic solvent vapors.

Yet another object is to provide an enclosure for a solvent collector which vents the vapors away from the fraction collection directly to an adjacent hood.

Still yet another object is to provide a low cost solvent vapor venting dust cover for a fraction collector turntable which allows an employee easy access to fractions without exposing him to any toxic vapors. Other objects will readily occur to those skilled in the art.

SUMMARY OF THE INVENTION

In keeping with an aspect of this invention, these and other objects are accomplished by having a solvent vapor venting dust cover unit consisting of an enclosure for a solvent collector turntable which assists in venting the vapors directly to an adjacent hood and a two part cover positioned over and in abuttment with the enclosure. Air flow through the unit is drawn from an air intake aperture to an air exhaust hose due to the connection of the hose with the hood ventilation system. Thus, no auxiliary fan is needed. The enclosure cover is removable, but while in place acts as a dust cover for the collection vessels. The cover being easily movable, has the added advantage of making access to the enclosed fractions easy.

BRIEF DESCRIPTION OF THE DRAWINGS

The nature of the preferred embodiment will be understood best from a study of the attached drawings wherein.

DESCRIPTION OF THE PREFERRED EMBODIMENT

Figure 1:
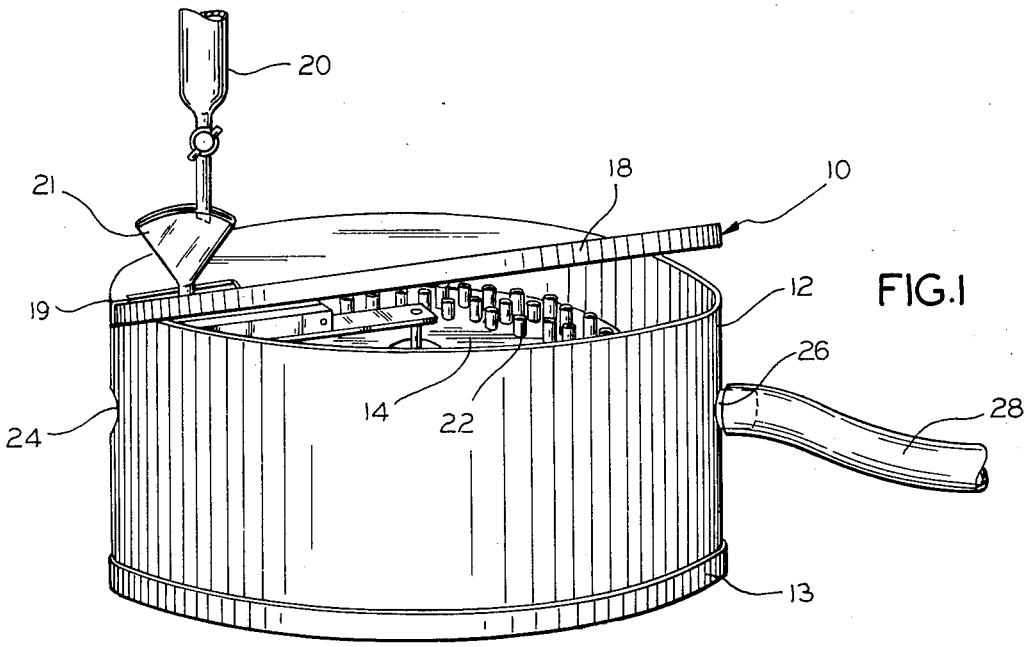
FIG. 1 is a perspective view of a solvent vapor venting dust cover unit showing a preferred embodiment incorporating the features of the invention.

The solvent vapor venting dust cover unit of FIG. 1 is made primarily of flat rolled aluminum. The solvent vapor venting dust cover unit, (hereinafter referred to as the unit) includes a cover 10 positioned over and in abutting relationship with an enclosure 12. The enclosure 12 is conveniently supported on a turntable base plate 13 of a fraction collector 14. While the enclosure 12 is shown as being cylindrical, it is to be understood that the shape can be made to conform to any fraction collector 14. Therefore, the enclosure 12 can be square, rectangular or any other shape.

The cover 10 is divided in the middle, providing two separate and distinct sections 15 and 16. The individual sections 15, 16, are constructed with an offset lap joint 17 and a rolled edge 18. There is also an opening 19 at one side of offset lap joint 17 permitting easy collection of solvent fractions in the turntable. The use of sections 15, 16 with offset lap joints 17 which are overlapped and rolled edge 18, forms a semi-air-tight enclosure when placed upon the cylinder 12.

The cylinder 12 is constructed to completely encircle a solvent collection turntable 14. Thus, in use, a solvent in a column 20 dripping at a pre-set rate, drops through a funnel 21 extending through opening 19 into test tubes 22 in the solvent collection turntable 14. Any vapors from the solvent are removed by the means described in the following paragraphs.

Figure 2:
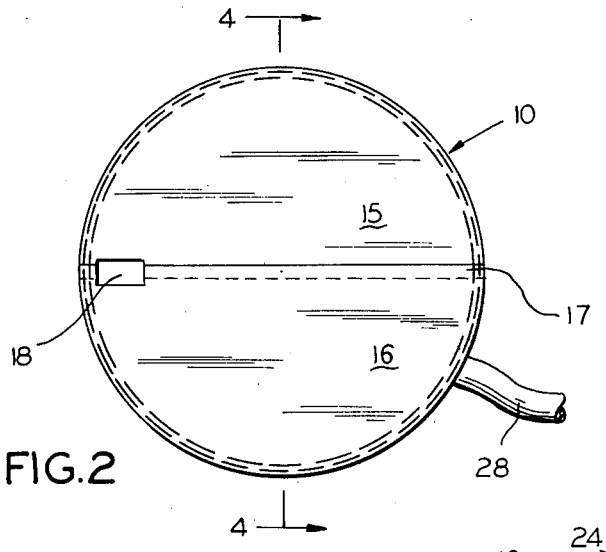
FIG. 2 is a top plan view of the inventive solvent vapor venting dust cover unit.
Figure 4:
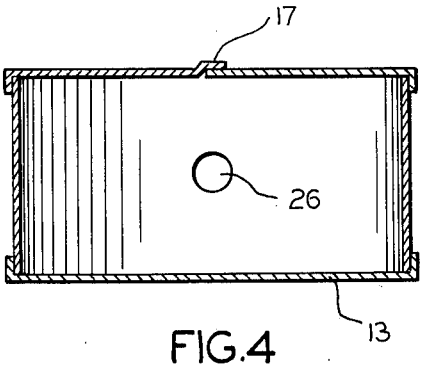
FIG. 4 is a side elevation view of the inventive solvent vapor venting dust cover unit taken along, and looking in the direction of line 4—4 of FIG. 2.

The nature of the inventive concept is easily apparent from a study of FIGS. 1, 2 and 4. The cylinder 12 is provided with an air intake aperture 24 on one side and an air exhaust outlet spout 26 with an outwardly extending hose 28 on the opposite side. The outwardly extending hose 28, is connected to an adjacent hood. Air flow is drawn through the unit from the hood ventilation system. Thus, no auxiliary fan is required and all solvent vapors are easily removed from the unit.

When the unit is in use, a slightly negative air pressure is created within, thus also assisting in removing solvent vapors from the working area. This easily protects laboratory workers from being endangered by toxic or noxious solvent vapors. Also, all foreign matter, i.e., dust is kept away from the solvent fractions and contamination is prevented.

Figure 5:
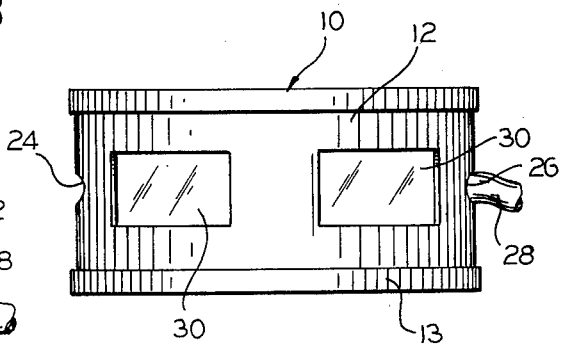
FIG. 5 is a second embodiment of the inventive solvent vapor venting dust cover unit.
Figure 3:
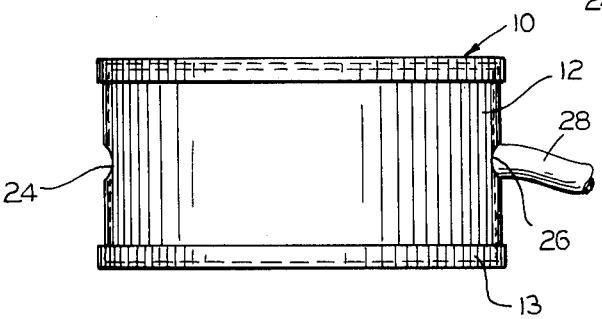
FIG. 3 is a side elevation view of the inventive solvent vapor venting dust cover unit.

As shown in FIG. 1, the sections 15, 16 are freely movably about the enclosure 12 and removable from the enclosure 12. Thus, the sections 15, 16 may be lifted or easily swung around over the top of the enclosure 12 and samples in test tubes 22 may be easily observed or removed for testing In an alternate embodiment illustrated in FIG. 5, Plexiglas windows 30 are placed around the sides of the enclosure 12 for easy viewing of the various samples.

While the principles of the invention have been described above in connection with specific apparatus and applications, it is to be understood that this description is made only by way of example and not as a limitation on the scope of the invention. Accordingly, the appended claims are to be construed to include all equivalent structures falling within the scope and spint of the invention.

I claim:

1. A solvent vapor venting dust cover unit for a fraction collector turntable comprising:

enclosure means housing said fraction collector turntable;

said fraction collector turntable having a base plate;

said enclosure means supported on said base plate;

removable cover means positioned over and in a abutting relationship with said enclosure means, and wherein said removable cover means is split to provide two separate and distinct sections, each of said sections having a rolled edge and an offset lap joint;

said removable cover means having an opening therein;

said opening providing means for a solvent to be dropped into test tubes within said fraction collector turntable;

said enclosure means having spaced apart air intake means and air exhaust means;

said air exhaust means including an outwardly extending hose extending from said air exhaust means and said hose being connectable to an adjacent hood whereby air flow is drawn out of said unit through said air exhaust means through a ventilation system within said hood; and said air intake means and said air exhaust means located opposite each other in said enclosure whereby any solvent vapors within said enclosure means are drawn out of said enclosure means.

2. The solvent vapor venting dust cover unit of claim 1 wherein:

said sections of said removable cover means are freely movable about said enclosure means.

3. The solvent vapor venting dust cover unit of claim 1 wherein:

said enclosure means includes observation means; and said observation means comprise Plexiglas windows whereby samples in test tubes in said fraction collector may be observed.

* * * * *